US006547808B2

(12) United States Patent
Tuckey et al.

(10) Patent No.: US 6,547,808 B2
(45) Date of Patent: Apr. 15, 2003

(54) INFANT FLUID DISPENSER

(75) Inventors: Steven R. Tuckey, Freeland, MI (US); John M. Hess, III, Midland, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/908,049

(22) Filed: Jul. 18, 2001

(65) Prior Publication Data

US 2003/0018359 A1 Jan. 23, 2003

(51) Int. Cl.[7] ..... A61J 17/00
(52) U.S. Cl. ..... 606/234; 604/77
(58) Field of Search ..... 606/234, 235, 606/236; 604/77, 78, 79, 73; 215/11.1, 11.3, 11.4, 11.5, 11.6

(56) References Cited

U.S. PATENT DOCUMENTS 4,078,566 A * 3/1978 Urban, Jr. ..... 606/234
4,192,307 A * 3/1980 Baer ..... 215/11.1
5,514,142 A * 5/1996 Dean-Homolka ..... 606/234
5,601,605 A 2/1997 Crowe et al.
5,772,685 A 6/1998 Crowe et al.
5,843,030 A * 12/1998 Van Der Merwe ..... 604/77
6,110,193 A 8/2000 Chen

FOREIGN PATENT DOCUMENTS

EP 0 617 948 B1 10/1994
EP 0 681 824 A1 11/1995

* cited by examiner

*Primary Examiner*—Danny Worrell
(74) *Attorney, Agent, or Firm*—Wood, Phillips, Katz, Clark & Mortimer

(57) ABSTRACT

A fluid dispenser is provided with a fluid containment unit and a support unit. The fluid containment unit includes a bulb, a nipple, and a tether connecting the bulb to the nipple. The support unit includes a face plate, a retaining ring, and a releasable latch for securing the face plate and retainer ring together to clamp between them the fluid containment unit when the fluid containment unit is in a folded configuration locating the bulb and nipple in communication with each other.

44 Claims, 10 Drawing Sheets

INFANT FLUID DISPENSER

CROSS REFERENCE TO RELATED APPLICATION

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a system suitable for dispensing a fluid, which may be a liquid medicine, to an infant.

BACKGROUND OF THE INVENTION AND TECHNICAL PROBLEMS POSED BY THE PRIOR ART

Designs have been proposed for a fluid administration system or medicine dispenser for use with infants. See, for example, U.S. Pat. Nos. 5,772,685, 5,601,605, and 6,110,193, and European patent application Publication No. 0 681 824 A1. While such designs provide certain useful features, it would be desirable to provide an improved fluid dispenser which could be more easily manufactured, which would provide additional benefits to the user, which could accommodate additional desirable features, and which could be incorporated in a relatively low-cost product.

It would be desirable to provide a design which could be incorporated in a product having a minimum number of separate pieces or components requiring assembly.

It would also be beneficial if a product with such an improved design could be easily operated by a person administering fluid to an infant. Such an improved design should readily accommodate opening of the dispenser, filling of the dispenser with the desired amount of fluid, and closing of the dispenser.

It would also be beneficial if an improved dispenser could be provided with means for holding the dispenser in a closed, dispensing configuration as well as with means for maintaining the dispenser in an open configuration to accommodate filling with a fluid to be dispensed.

It would also be advantageous if an improved infant fluid dispenser could be designed to be used by an infant in a way that would not obstruct the infant's breathing.

It would also be desirable to provide an improved infant fluid dispenser which would incorporate features for aligning portions of the dispenser when it is moved from an open, fluid-filling configuration to a closed configuration.

Additionally, it would be beneficial if an improved infant fluid dispenser could accommodate a configuration which would allow the dispenser to be positioned in an upright, storage position on a support surface. This may have the additional benefit of reducing the likelihood of contamination of surfaces that contact the infant's mouth.

Also, it would be desirable to provide an improved infant fluid dispenser which would eliminate, or at least minimize, the likelihood of the dispenser, or separate parts thereof, being swallowed or otherwise posing a choking hazard to an infant.

Further, it would be desirable if such an improved dispenser could accommodate efficient, high-quality, high-speed, large-volume manufacturing techniques with a reduced product reject rate to produce a dispenser with consistent operating characteristics unit-to-unit.

The present invention provides an improved infant fluid dispenser which can accommodate designs having the above-discussed benefits and features.

BRIEF SUMMARY OF THE INVENTION

The present invention provides an infant fluid dispenser that is assembled from a minimum number of components. Each component by itself, as well as the completely assembled dispenser, cannot be swallowed by an infant and does not pose a choking hazard for the infant. In the preferred embodiment, the dispenser includes only two unitary components that are assembled together: a fluid containment unit and a support unit.

In the preferred embodiment, the fluid containment unit is a completely flexible, deformable structure preferably molded from silicone. The fluid containment unit includes (1) a bulb having a discharge opening, (2) a nipple having (a) an inlet opening, and (b) a dispensing orifice, and (3) a tether connecting the bulb with the nipple to accommodate (a) an unfolded configuration allowing access to the interior of the bulb for filling the bulb with fluid, and (b) a folded configuration locating the bulb discharge opening in communication with the nipple inlet opening.

The support unit includes (1) a face plate from which the nipple can project, (2) a retaining ring from which the bulb can project, and (3) a releasable latch for securing the face plate and retainer ring together to clamp between them the fluid containment unit when the fluid containment unit is in the folded configuration. In the preferred form, the support unit is a generally rigid, molded thermoplastic structure.

In the preferred embodiment, the fluid containment unit has a size which is sufficiently large with respect to the infant's mouth and throat to prevent the fluid containment unit from being swallowed by the infant when the fluid containment unit is separated from the support unit and is either in the unfolded configuration or in the folded configuration.

Also, in the preferred embodiment, a hinge is provided in the support unit for connecting the face plate and retainer ring. Preferably, the releasable latch for securing the face plate and retainer ring together is located about 180° from the hinge and is defined solely by a portion of the face plate and a portion of the retainer ring which together form a releasable snap-fit engagement. In the most preferred form of the latch, the face plate includes a resilient tab having (1) a projecting shoulder, and (2) a tapered surface, and the retainer ring has (1) a guide surface for engaging the tapered surface, and (2) an abutment surface for confronting the shoulder to latch the face plate and retainer ring together.

In the preferred embodiment, additional features are incorporated, including (1) an annular plug seal at the nipple inlet opening for being sealingly received in the bulb discharge opening, (2) sufficient resiliency in the tether so as to exert at least a small force tending to urge the bulb away from the nipple when the support unit is not closed to clamp the fluid containment unit in the folded configuration, (3) a ventilation aperture in the face plate outwardly of the nipple to admit air to the region adjacent the nose of the infant, (4) an exterior surface portion on the end of the bulb for supporting the dispenser on a flat surface, (5) posts on the support unit face plate, and corresponding apertures in the fluid containment unit for effecting an interference engagement to assist in retaining the fluid containment unit adjacent the support unit, (6) a central opening in the face plate for receiving the nipple, (7) a central opening in the retainer ring for receiving the bulb, and (8) a connection between the support unit face plate and support unit retainer ring comprising two, spaced-apart film hinges between which the fluid containment unit tether can be located.

In another embodiment, the fluid dispenser is made in three pieces or parts. A nipple is provided with an inlet opening and a the dispensing orifice. A face plate is provided for engaging a portion of the nipple from which the nipple can project. The dispenser also includes a retainer ring and a bulb having a discharge opening. The bulb is non-removably attached to the retainer to allow access to the interior of the bulb for filling the bulb with fluid. Preferably, the bulb is bi-injection molded onto the retainer ring. The bi-injection molding of the bulb to the retainer ring provides a single, integral piece or structure. Other forms of permanent attachment could be employed. However, bi-injection molding is a contemplated preferred form of permanent attachment where the retainer ring is molded from a thermoplastic material and where the bulb is molded from an elastomer, such as silicone. The fluid dispenser also includes a releasable latch for securing the face plate and retainer ring together to clamp between them the nipple in an orientation with the nipple inlet opening in communication with the bulb discharge opening. Preferably, in this three-piece embodiment, each of the three pieces is large enough so that it cannot be swallowed by an infant so as to cause choking.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

Figure 9:
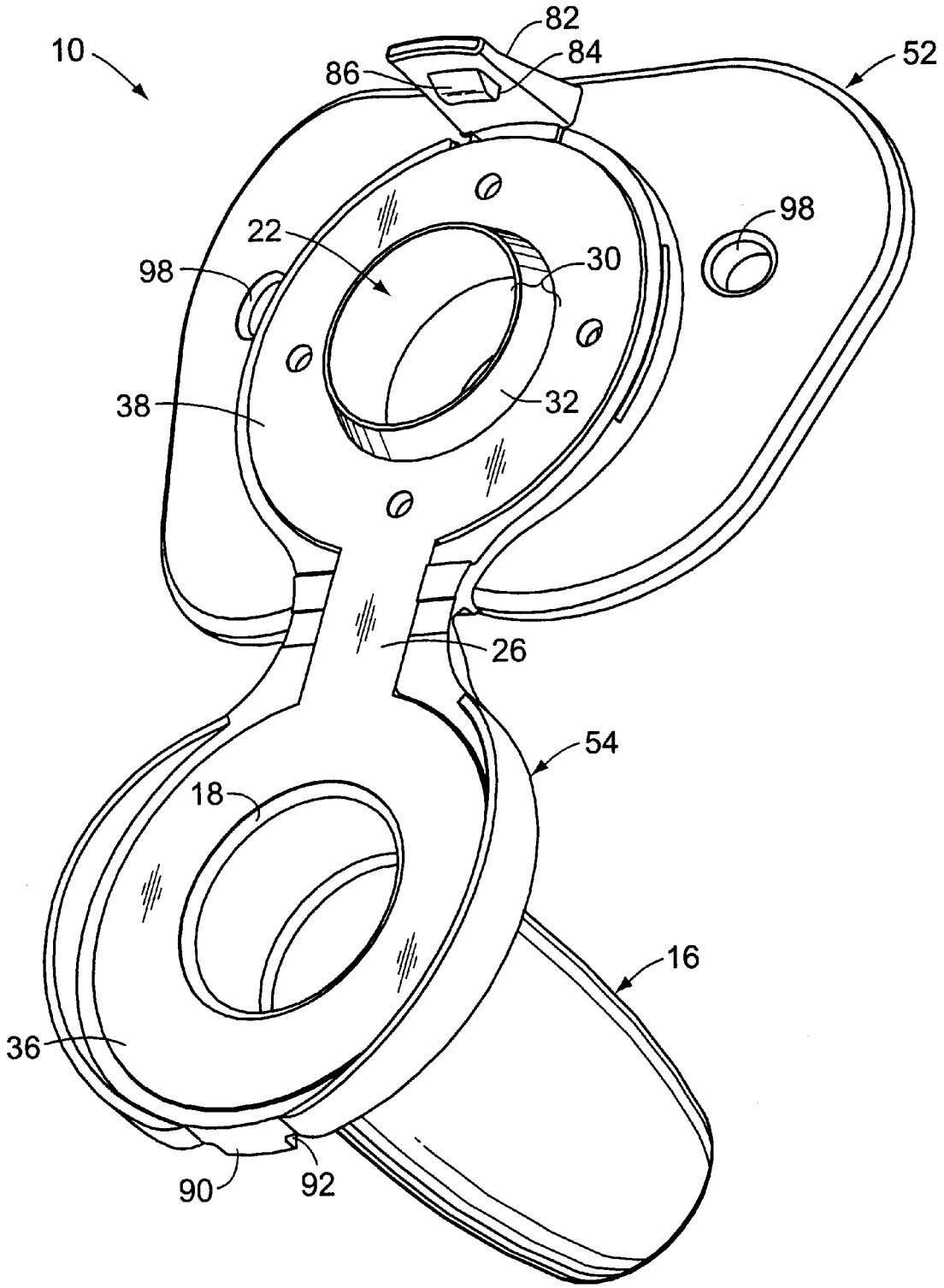
FIG. 9 is a perspective view similar to FIG. 1, but FIG. 9 shows the dispenser in an unlatched, open configuration which allows the dispenser to be emptied or filled.

In FIGS. 1–4, the presently preferred embodiment of the infant fluid dispenser of the present invention is designated generally by the reference number 10 and is shown in a closed configuration. This closed configuration is the configuration that is used for dispensing fluid to an infant after the dispenser has been filled with a fluid (such as liquid medication). The unlatched, open configuration as shown in FIG. 9 accommodates filling or re-filling of the dispenser with fluid, such as a liquid medication.

Figure 5:
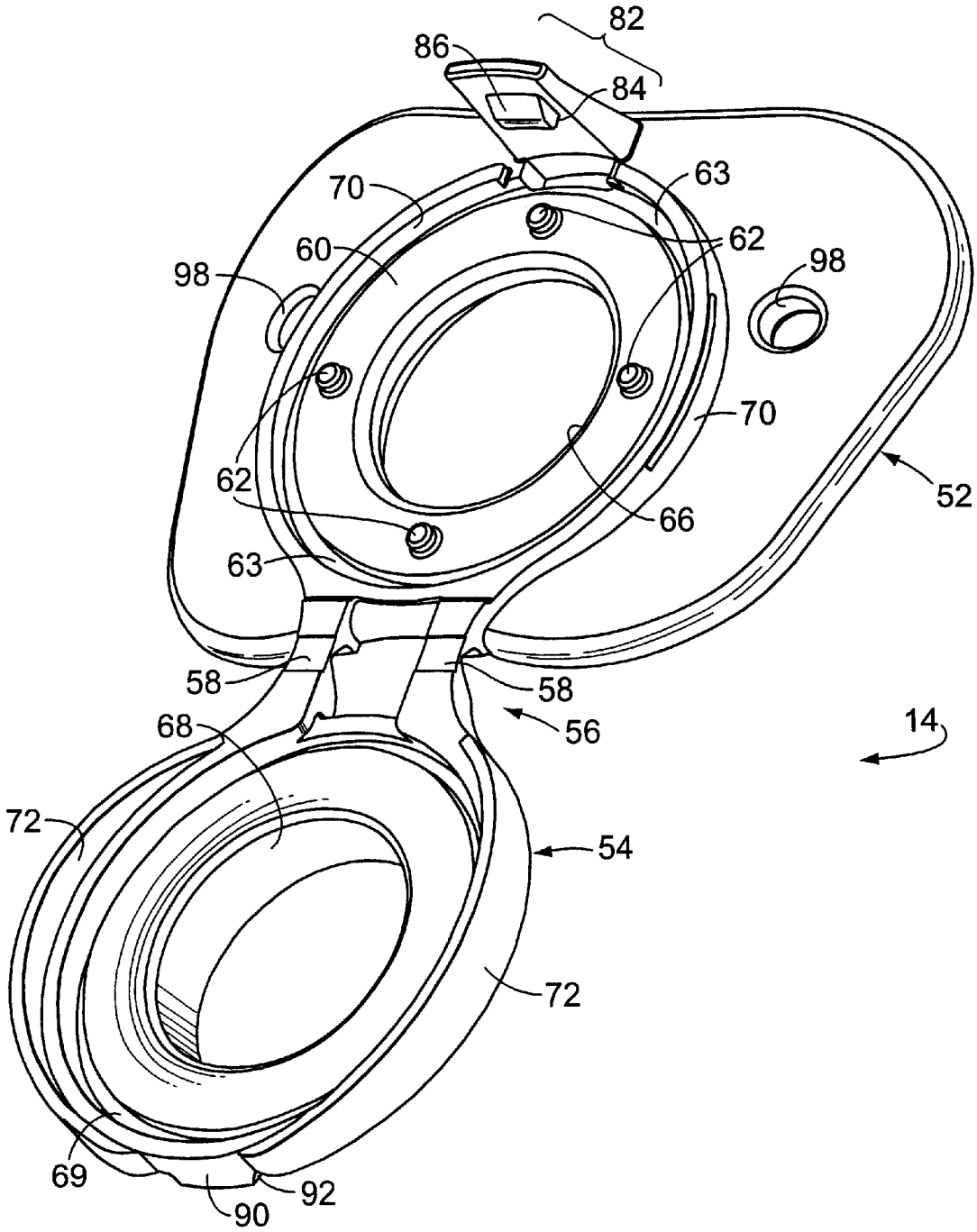
FIGS. 5 is a view of the support unit component of the dispenser shown in the open configuration to reveal the inside, clamping surfaces.
Figure 6:
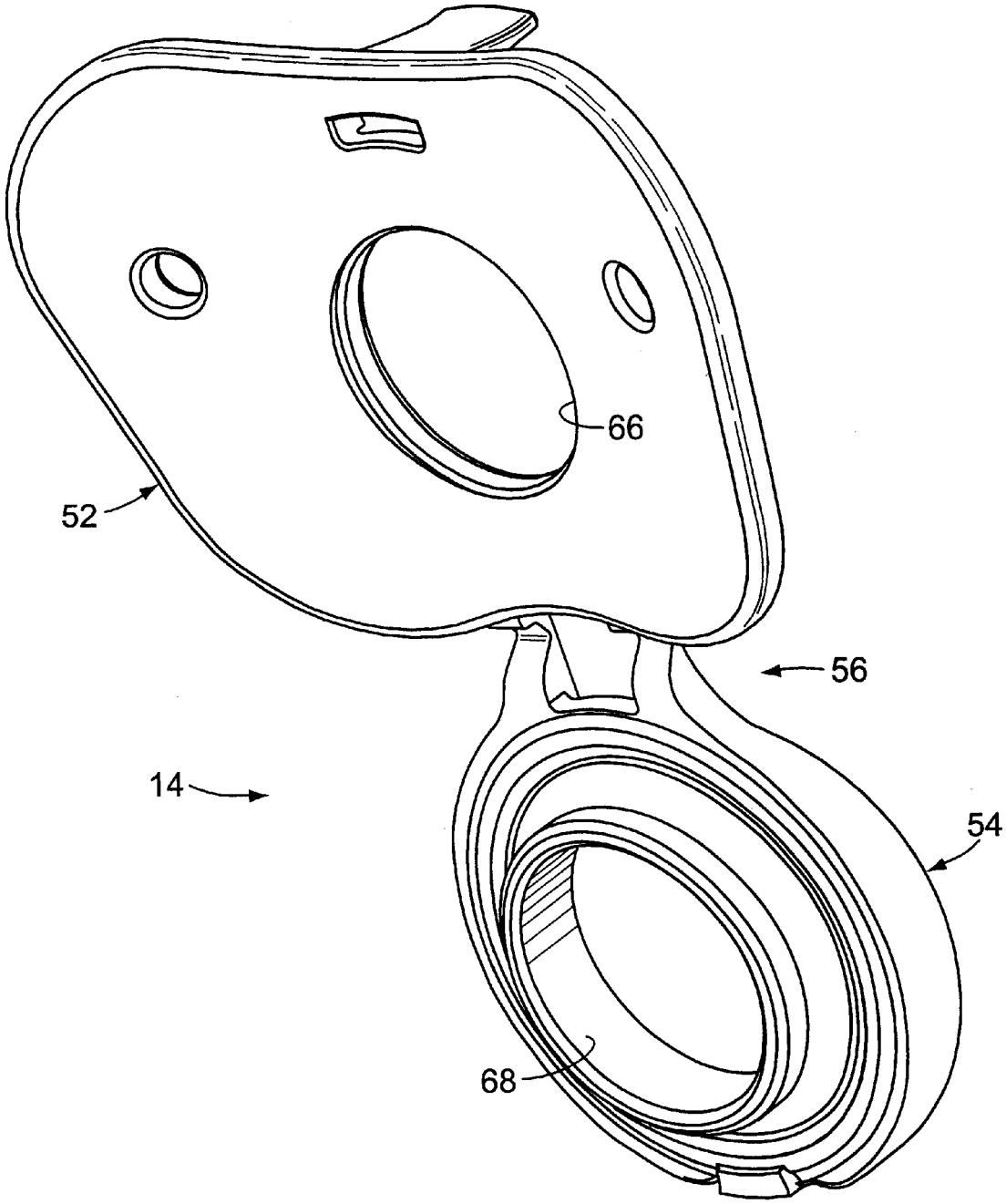
FIG. 6 is a perspective view of the support unit shown in the open configuration to reveal the exterior surfaces.
Figure 7:
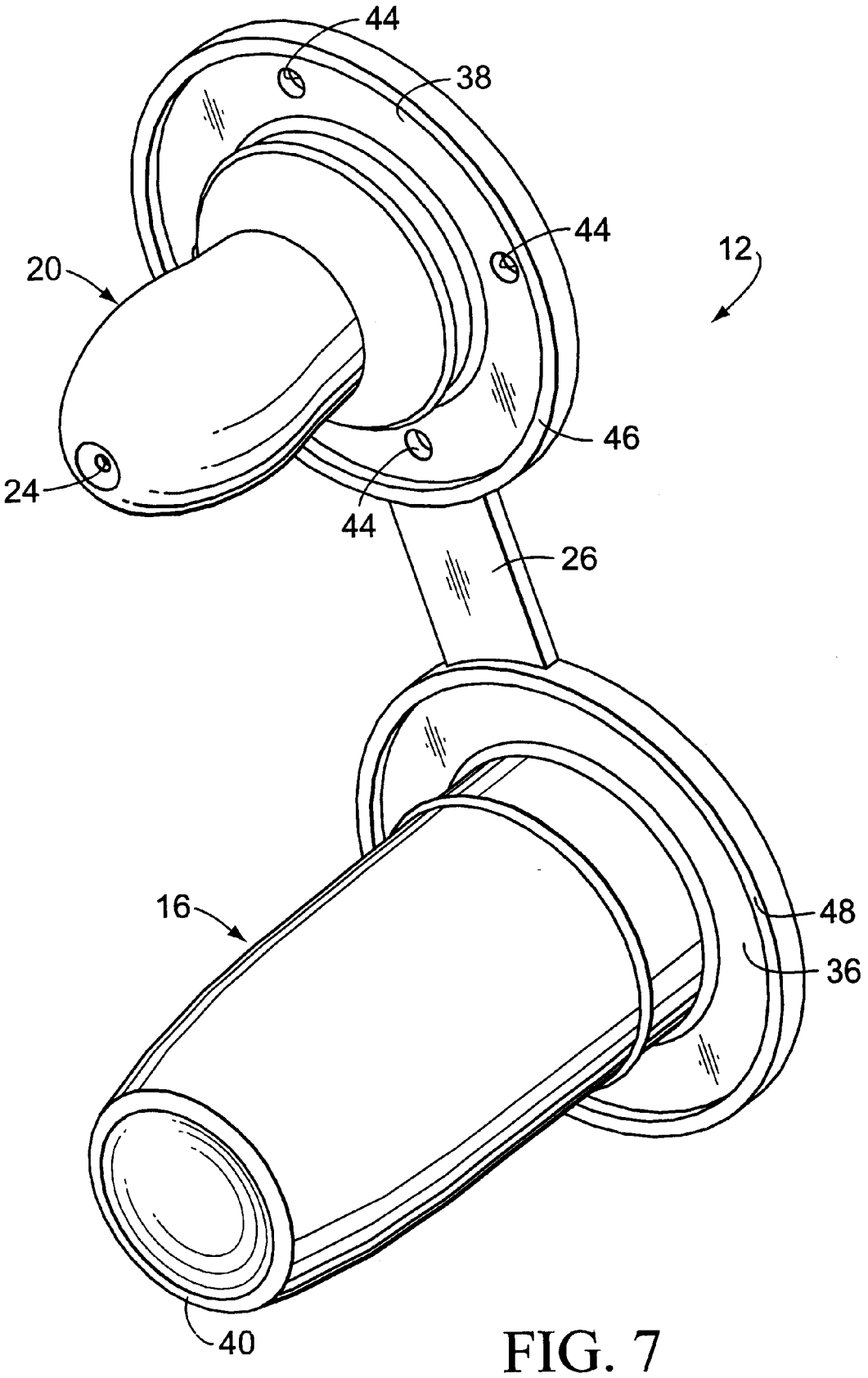
FIG. 7 is a perspective view of the fluid containment unit component of the dispenser in an unfolded, open configuration to reveal the exterior surfaces.
Figure 8:
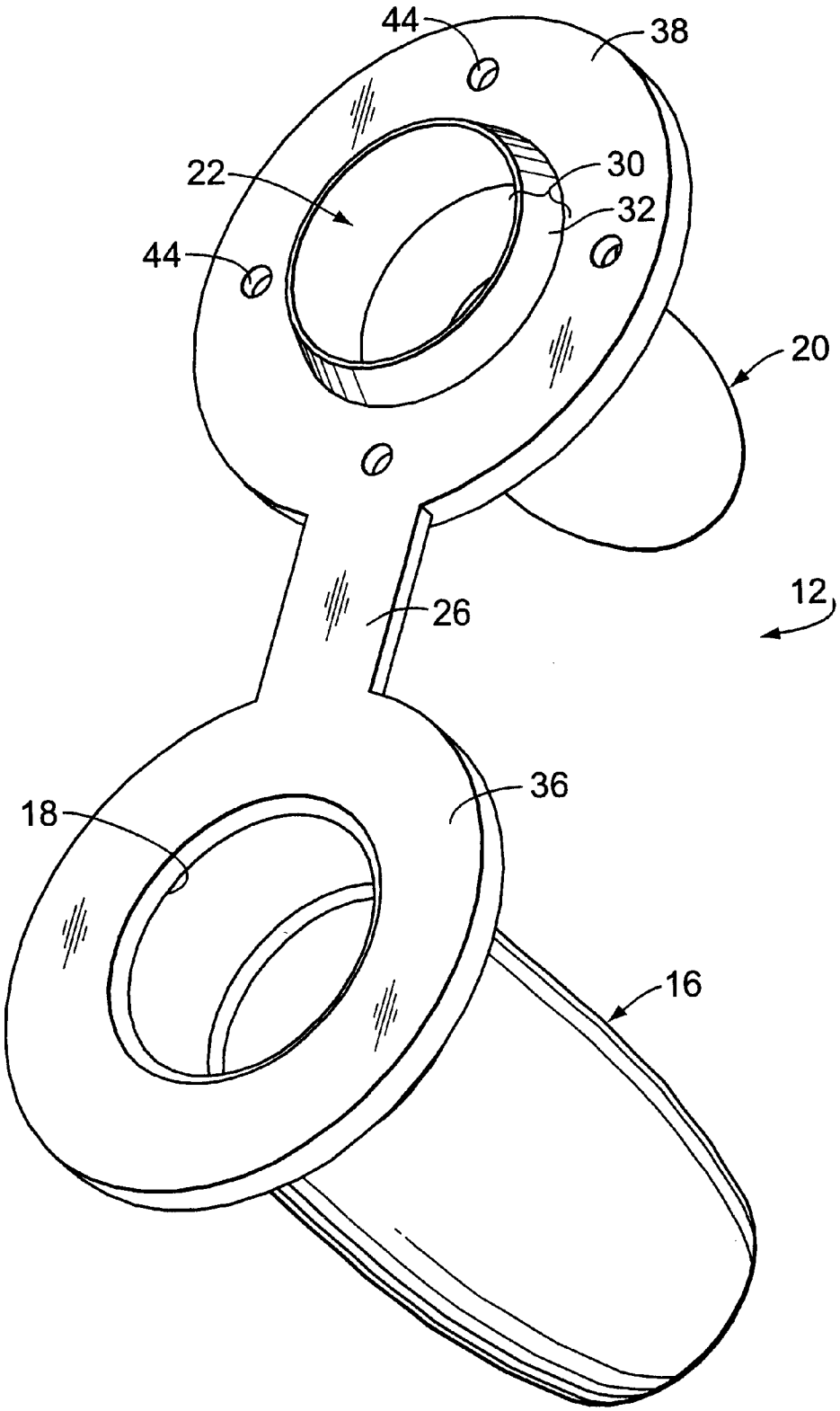
FIG. 8 is a perspective view of the fluid containment unit in the unfolded, open configuration to reveal the interior surfaces.

The dispenser 10, in the preferred embodiment includes only two components, a fluid containment unit 12 as shown in FIGS. 7 and 8, and a support unit 14 as shown in FIGS. 5 and 6.

In a presently preferred embodiment, the fluid containment unit 12 (FIGS. 7 and 8) is injection-molded from liquid silicone rubber sold under the designation DC 94-595HC by Dow Coming Corporation in the United States of America. The fluid containment unit 12 is typically injection-molded in the open, unfolded configuration illustrated in FIGS. 7 and 8.

The fluid containment unit 12 includes a bulb 16 having (1) a discharge opening 18 (FIG. 8), (2) a nipple 20 having (a) an inlet opening 22 (FIG. 8), and (b) a dispensing orifice 24 (FIG. 7), and (3) a tether 26 (FIGS. 7 and 8) connecting the bulb 16 to the nipple 20 to accommodate (1) an unfolded configuration (FIGS. 7 and 8) allowing access to the interior of the bulb 16 for filling the bulb with fluid, and (2) a folded configuration (FIG. 3) locating the bulb discharge opening 18 in communication with the nipple inlet opening 22.

In the preferred form, the bulb 16 is flexible and squeezable and functions as a reservoir for containing a fluid, such a liquid medicine. In the preferred embodiment illustrated in FIG. 3, the nipple dispensing orifice 24 is a small, normally open, cylindrical bore through the end of the nipple 20. The orifice 24 is so small that the liquid does not readily flow through it unless the liquid is forced through the orifice 24 by squeezing the bulb 16 and/or sucking on the nipple 20 to create a pressure differential across the orifice 24. However, it will be appreciated that the dispensing orifice 24 could also be a normally closed orifice, such as slit (not illustrated) that would be openable in response to a force applied to temporarily deform the nipple, such as by an infant squeezing the nipple in the infant's mouth, or by applying a pressure differential across the orifice by squeezing on the bulb 16 and/or applying a suction to the exterior of the nipple 20.

Figure 1:
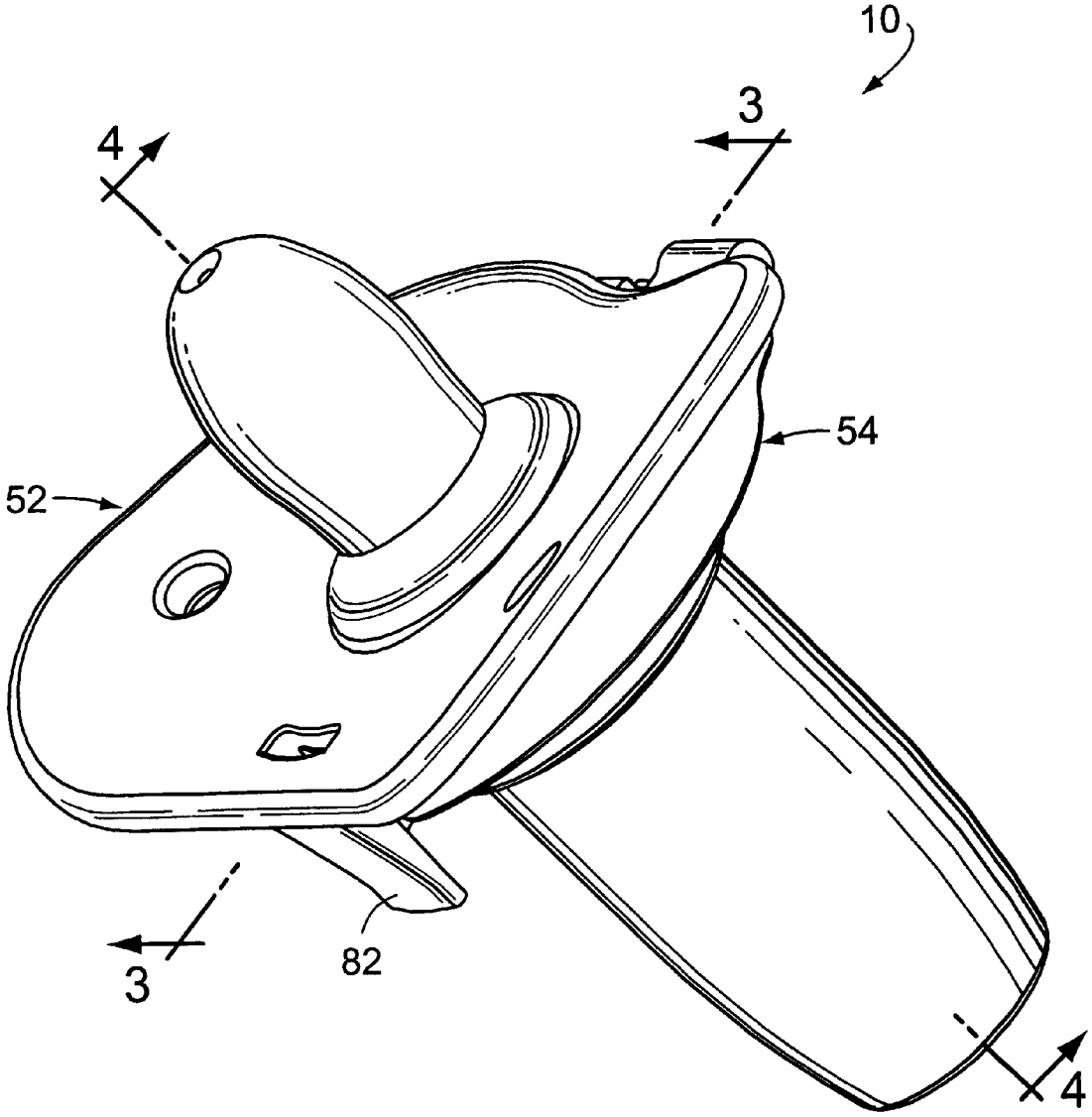
FIG. 1 is a top perspective view of a preferred embodiment of the dispenser of the present invention shown in the folded and latched closed configuration.
Figure 2:
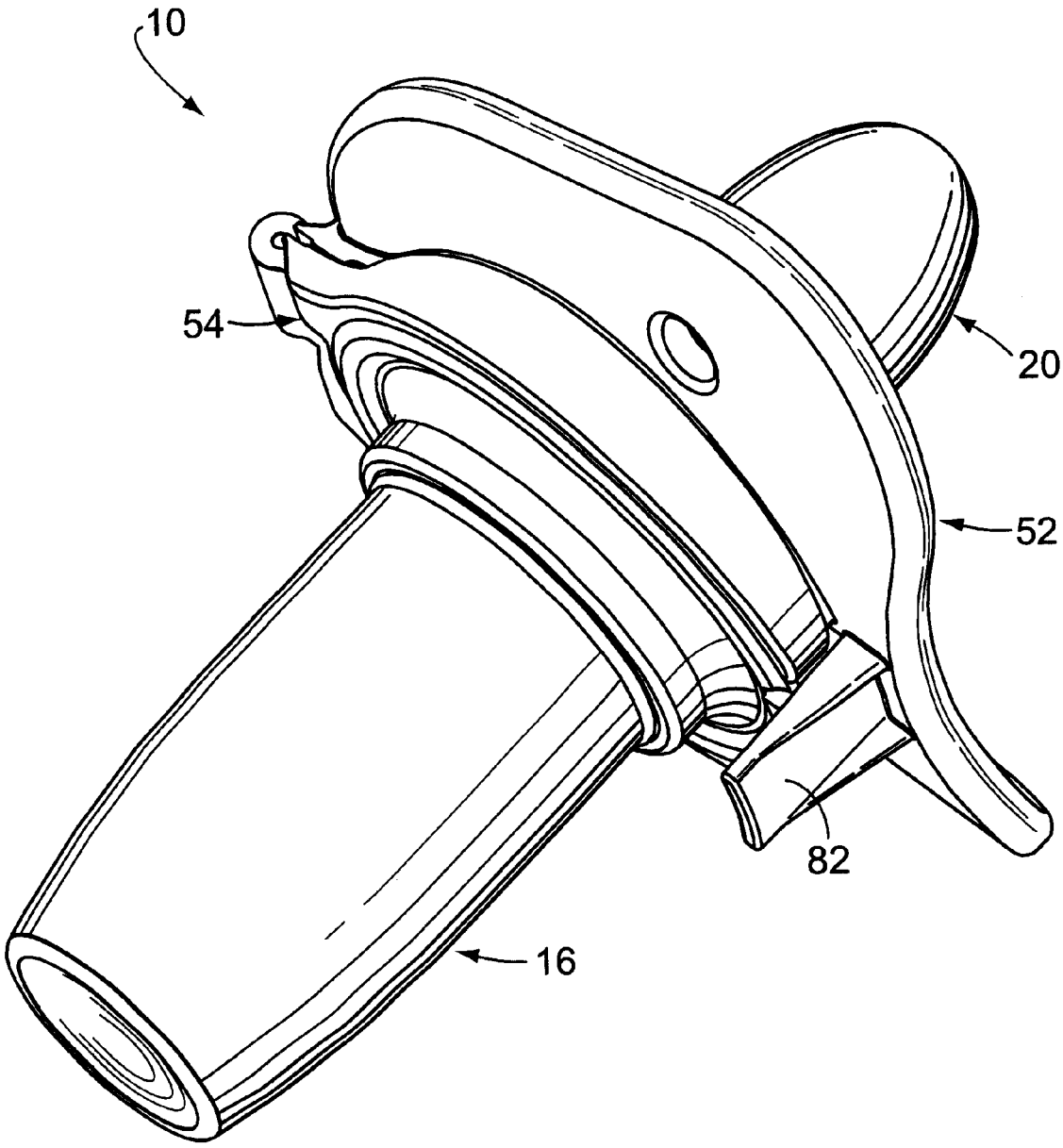
FIG. 2 is a bottom perspective view of the dispenser.
Figure 3:
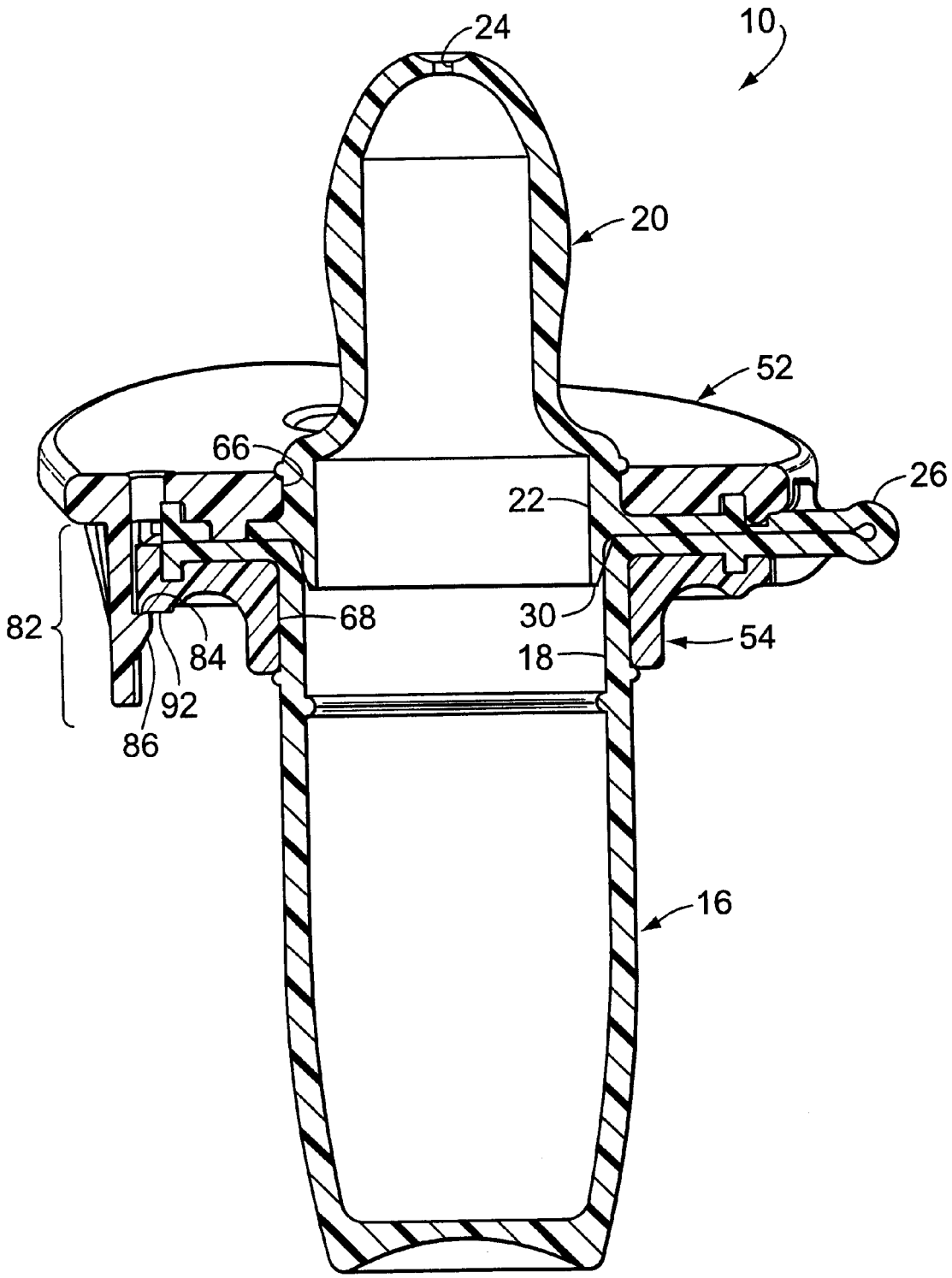
FIG. 3 is a cross-sectional view taken generally along the plane 3—3 in FIG. 1.

In the preferred embodiment, the nipple inlet opening 22 (FIG. 8) is defined by an annular plug seal 30 which has a generally tapered, frustoconical, exterior surface 32 (FIG. 8) for being sealingly received in the bulb discharge opening 18 as shown in FIG. 3 when the fluid containment unit 12 is in a folded configuration (FIG. 3) locating the bulb discharge opening 18 in communication with the nipple inlet opening 22.

In the preferred embodiment, the fluid containment unit tether 26 has a resiliency sufficient to urge the bulb 16 away from the nipple 20 when the fluid containment unit is generally unconstrained (such as in the as-molded configuration illustrated in FIG. 8) and is not held in the folded configuration illustrated in FIGS. 1–4.

Preferably, the fluid containment unit 12 includes a flange 36 (FIG. 8) around the bulb discharge opening 18 at the end of the bulb 16. Also, preferably, the fluid containment unit 12 includes a flange 38 (FIG. 8) around the plug seal 32 at the base of the nipple 20.

Figure 4:
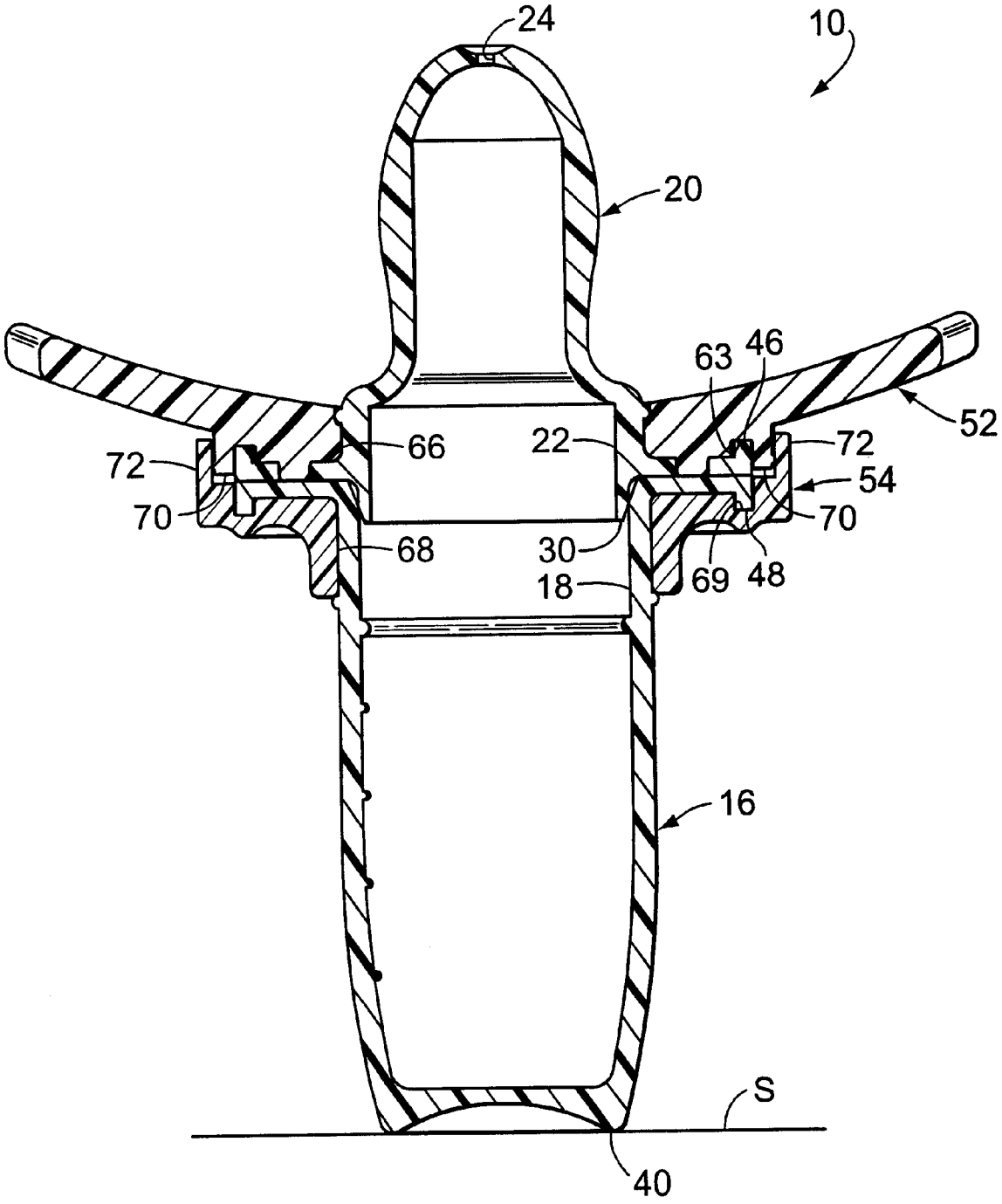
FIG. 4 is a cross-sectional view taken generally along the plane 4—4 in FIG. 1.

As shown in FIG. 7, the distal end of the bulb 16 also preferably has an exterior surface portion 40 which can function as a base for supporting the dispenser 10 on a flat surface S as shown in FIG. 4.

In the preferred embodiment illustrated in FIGS. 7 and 8, the fluid containment unit 12 has a plurality of apertures 44 defined in the flange 38. The apertures 44 are located radially outwardly of, and around, the nipple inlet opening 22 (FIG. 8).

In the preferred embodiment illustrated in FIG. 7, the fluid containment unit 12 also includes a rim 46 on one side of the flange 38 at the periphery of the flange 38, and includes a rim 48 on one side of the flange 36 at the periphery of the flange 36.

As shown in FIGS. 5 and 6, the support unit 14 includes a face plate 52 and a retainer ring 54. In the preferred embodiment, a hinge 56 connects the face plate 52 with the retainer ring 54. The hinge 56 preferably comprises two spaced-apart film hinges 58 (FIG. 5) which define between them a space to accommodate the tether 26 (FIG. 9) of the fluid containment unit 12 when the fluid containment unit 12 is mounted on and in the support unit 14.

In the preferred embodiment illustrated in FIG. 5, the face plate 52 includes a central opening 66 for receiving the nipple 20, and the retainer ring 54 defines a central opening 68 for receiving the fluid containment unit bulb 16 as shown in FIG. 3.

With reference to FIG. 5, the preferred embodiment of the support unit 14 includes an annular seat 60 for receiving the flange 38 of the fluid containment unit 12 (FIG. 7). Projecting upwardly from the seat 60 is a plurality posts 62 for being received in the fluid containment unit flange apertures 44. Preferably, each post 62 is generally cylindrical, and each aperture 44 is a cylindrical bore having a diameter slightly less than the post diameter so as to receive a post 62 in an interference fit to assist in retaining the fluid containment unit 12 adjacent the support unit 14 when the two units are mounted together (FIG. 9). Alternatively, the distal end of each post 62 could have a slightly enlarged distal end or bead for retaining the fluid containment unit flange 38 in place on the post 62. In another alternative design (not illustrated), the posts 62 and apertures 44 may be eliminated altogether. In another alternative (not illustrated), the posts 62 could be incorporated on the retainer ring 54 instead of the face plate 52, or the posts 62 could also be incorporated in both the face place 52 and the retainer ring 54.

As shown in FIG. 4, the support unit face plate 52 preferably defines an annular groove 63 for receiving the nipple flange rim 46.

In the preferred embodiment illustrated in FIG. 5, the retainer ring 54 defines an annular seat 67 for receiving the flange 36 of the fluid containment unit 12.

As shown in FIG. 6, the support unit retainer ring preferably includes an annular groove 69 for receiving the bulb flange rim 48.

In the preferred embodiment illustrated in FIG. 5, the face plate 52 includes a pair of arcuate locating walls 70 which define between them a receiving region for the fluid containment unit flange 38 as shown in FIG. 4.

The support unit retainer ring 54 includes a pair of arcuate guide walls 72 for cooperating with the arcuate wall 70. As shown in FIG. 4, the retainer ring arcuate guide walls 72 lie radially outwardly of, but adjacent the face plate locating walls 72 so as to function to guide the face plate 52 and retainer ring 54 into a confronting relationship when the two components are brought together in a folded configuration to clamp between them the fluid containment unit flanges 36 and 38 as shown in FIG. 4.

A releasable latch is provided in the fluid dispenser 10 for securing the face plate 52 and retainer ring 54 together to clamp between them the fluid containment unit 12 in the folded configuration. In the preferred embodiment, the latch is defined solely by a portion of the face plate 52 and a portion of the retainer ring 54 which together form a releasable snap-fit engagement. In particular, the face plate 52 includes a resilient tab 82 having a projecting shoulder 84 and a tapered surface 86 (FIG. 5). The retainer ring 54 has (1) a guide surface 90 (FIG. 5) for engaging the tapered surface 86 as the face plate 52 and retainer ring 54 are moved toward each other to the closed configuration, and (2) an abutment surface 92 (FIGS. 3 and 5) for confronting the shoulder 84 to latch the face plate 52 and the retainer ring 54 together.

Preferably, the face plate 52 also includes a ventilation aperture or bore 98 outwardly of the central opening 66 to admit air to the region adjacent the nose of the infant when the nipple 20 is in the infant's mouth and the infant's nose is close to, or touching, a portion of the face plate 52.

The design of the dispenser 10 according to the principles of the present invention provides a dispenser which (1) has only a small number of components that are easy to assemble, and (2) can be readily operated by the user. In the preferred embodiment, the fluid containment unit 12 is a unitary structure, and the support unit 14 is a unitary structure. Preferably, the fluid containment unit 12 is molded from a silicone rubber, and the support unit 14 is molded from a thermoplastic material, such as polypropylene which is relatively rigid compared to the soft, flexible silicone rubber from which the fluid containment unit 12 is preferably molded. The fluid containment unit could be molded by means of bi-injection molding into the support unit 14. Also, the components, or portions of the components, could be molded with suitable multi-injection molding processes.

It will be appreciated, however, that the support unit 14 could be made from two separate components which are subsequently hinged together by the manufacturer with a hinge structure that permits the support unit face plate and retainer ring to be opened and closed by the user.

In an alternate embodiment (not illustrated), the support unit hinge 56 could be provided with a structure having more of a biasing force tending to urge the support unit 14 toward the full open, unlatched configuration shown in FIG. 5. Such a modified hinge could include spring arms, overcenter toggle hinge structures, etc.

To use the dispenser 10, the user merely pushes the latch tab 82 outwardly to release the latch, and then the user lifts the face plate 52 outwardly away from the retainer ring 54 to expose the opening 18 to the interior of the bulb 16 (FIG. 9). The bulb 16 can then be filled with the desired amount of fluid, such as a liquid medicine. Then the user closes the face plate 52 against the retainer ring 54 with a force sufficient to engage the latch tab 82 with the retainer ring abutment surface 84 to securely latch the dispenser 10. The nipple 20 can then be inserted in the infant's mouth, and the bulb 16 can be squeezed to assist in dispensing the fluid into the infant's mouth.

In an alternate embodiment, the bulb 16 may be a rigid structure, and with such an alternate design, fluid is dispensed into the infant's mouth by gravity flow and by the infant sucking on the nipple 20.

Owing to the unique design features of the dispenser 10, the dispenser 10 can be made in a convenient size which, while small enough to be readily used by an infant, nevertheless will not pose a choking hazard to the infant. In particular, even if the dispenser components are disassembled and separated, the components are too big or too long to be swallowed by the infant so as to cause choking.

At least a portion of the fluid containment unit 12 is flexible, and thus the unit 12, if separated from the support unit 14, could possibly be folded or flexibly deformed by an infant into a smaller configuration. However, because the nipple and bulb of the fluid containment unit are connected by a tether to define a unitary structure, the overall size is sufficiently large to eliminate a choking hazard even when the unit 12 is flexed, folded, or otherwise temporarily deformed.

A test for infant choking hazards in the United States of America may be described with reference to 16 Code of Federal Regulations Part 1511, ES DOC 540732, Engineering Test Manual Requirements For Pacifiers, 1984, as promulgated by the United States of America Consumer Products Safety Commission, Washington, D.C. FIG. 4 of the Manual illustrates a Small Parts Gage comprising a generally tubular structure having a cylindrical configuration with an internal diameter of 1.25 inch. The upper end is open, and the bottom end has an internally slanted closure end wall. Any separated component from a product is placed in the Small Parts Gage, so that the component is in the lowest position in the gage. If the uppermost edge of the component lies below the plane of the top of the cylinder of the gage, then the product that includes such a component fails the test because the separated component is deemed to be small enough that it may pose a choking hazard to an infant. The above-identified Manual is incorporated herein by reference thereto.

The fluid containment unit 12 of the present invention, with its unitary structure including the bulb, nipple, and tether, has sufficient dimensions, whether folded or unfolded, so that when it is made in a size and configuration suitable for use by an infant with a nipple of sufficient size to extend into the infant's mouth and with a bulb sufficient to hold the desired amount of fluid, at least a portion of the unit will extend out of the test gage. In a preferred embodiment, the bulb is designed to hold about at least four milliliters of fluid.

Owing to the unique arrangement of the tether 26 connecting the bulb 16 with the nipple 20, the particular size and configuration of the bulb and of the nipple can be made relatively small and/or made of relatively soft, flexible materials without the fluid containment unit 12 posing a choking hazard. Because of the tether 26, the overall size of the entire unitary fluid containment unit 12 is necessarily significantly larger than the size of either the bulb portion separately or nipple portion separately. It will be appreciated that the particular overall size of the fluid containment unit 12 would depend, at least in part, upon the particular choking hazard test guidelines or protocol employed (which could be those set forth in the above-discussed ES DOC 540743 or which could be some other guidelines which the product is intended to meet) and, perhaps, also upon the flexibility or deformability of the material or materials used for the construction of the fluid dispenser unit 12.

The dispenser support unit 14, in the preferred embodiment, is also a unitary structure comprising the face plate 52, retainer ring 54, and hinge 56. The overall size and configuration of the preferred form of the support unit 14, which is generally rigid (except for the hinge), is such that it cannot be received in the Small Parts Gage. Indeed, even if the support unit 14 did not have a unitary hinge, and instead had a separate face plate 52 and an unconnected, separate retainer ring 54, neither the preferred size of the face plate 52 nor the preferred size of the retainer ring 54 is small enough to fit within the Small Parts Gage.

Of course, according to another aspect of the dispenser invention, it will be appreciated that various novel features of the dispenser provide various benefits and advantages as discussed above which are separate and apart from, and which exist regardless of compliance or noncompliance with, any particular choking hazard design guidelines or test protocols.

Figure 10:
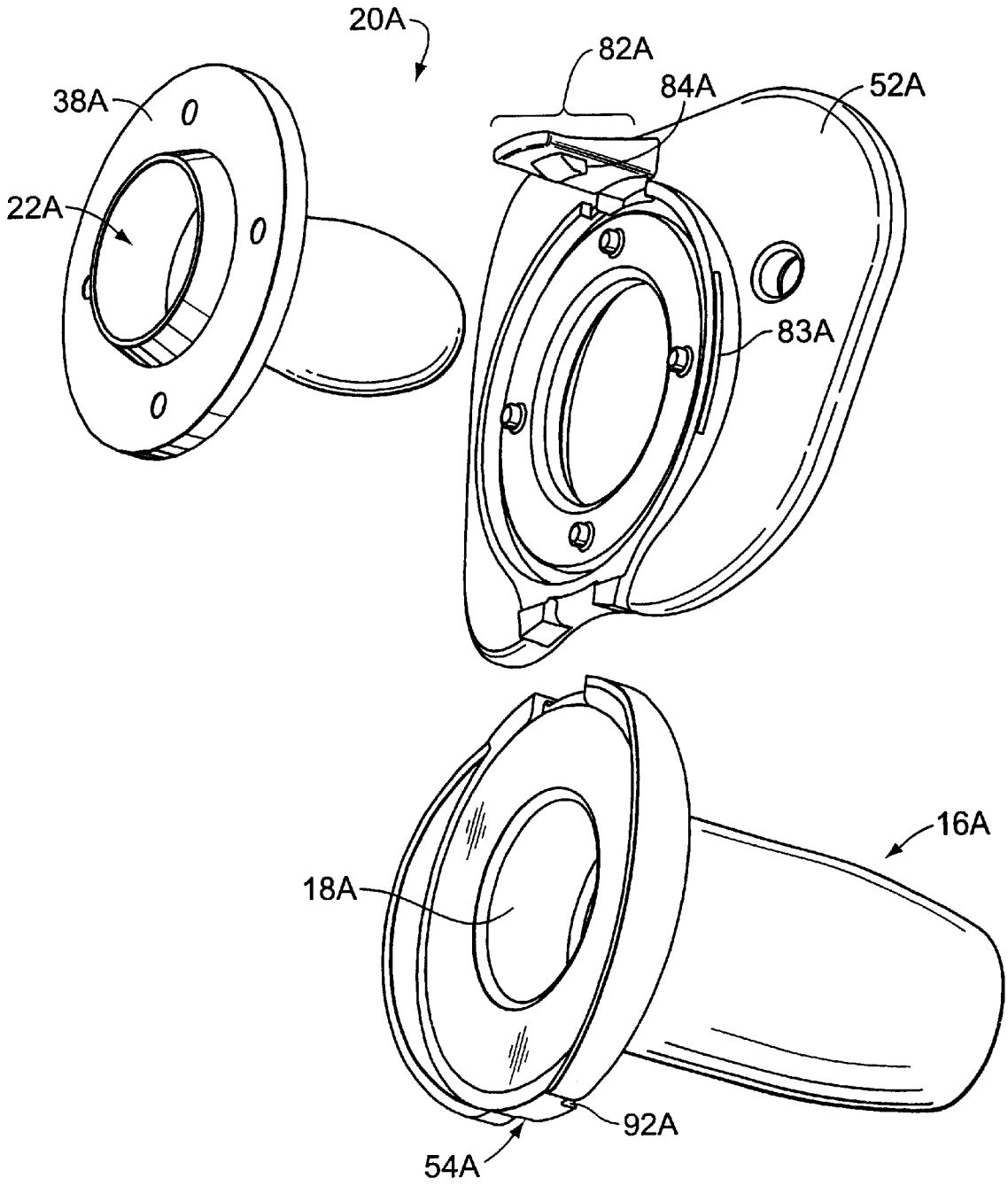
FIG. 10 is an exploded perspective view of an alternate embodiment of the dispenser.

In another embodiment illustrated in FIG. 10 and which includes most of the same features as illustrated in the first embodiment shown in FIGS. 1–9, a fluid dispenser 10A is made in three pieces or parts. A nipple 20A is provided with a flange 38A, an inlet opening 22A, and a dispensing orifice (identical with the first embodiment orifice 24 described above). A face plate 52A is provided for engaging a portion of the nipple (e.g., flange 38A) from which the nipple 20A can project. The dispenser 10A also includes a retainer ring 54A (similar to the first embodiment retainer ring 54 shown in FIG. 5) and a bulb 16A having a discharge opening 18A. The bulb 16A is non-removably attached to the retainer ring 54A to allow access to the interior of the bulb 16A for filling the bulb 16A with fluid. Preferably, the bulb 16A is bi-injection molded onto the retainer ring 54A. The bi-injection molding of the bulb 16A to the retainer ring 54A provides a single, integral piece or structure. Other forms of permanent attachment could be employed. However, bi-injection molding is a contemplated preferred form of permanent attachment where the retainer ring is molded from a thermoplastic material and where the bulb is molded from an elastomer, such as silicone. The fluid dispenser 10A also includes a releasable latch 82A for securing the face plate 52A and retainer ring 54A together to clamp between them the nipple 20A in an orientation with the nipple inlet opening 22A in communication with the bulb discharge opening 18A. (Additional retention forces can be provided with the engaging beads 83A on the face pate 52A.) Preferably, in this three-piece embodiment, each of the three pieces is large enough so that it cannot be swallowed by an infant so as to cause choking. The above-described alternate embodiment components are designated with reference numbers having the suffix "A," and these alternate embodiment components are identical with the first embodiment components illustrated in FIGS. 1–9 wherein the components have the same numbers but not the suffix "A"—except that in the alternate embodiment (1) the tether 26 (FIG. 8) between the nipple and bulb has been omitted, and (2) the hinge 56 (FIG. 5) between the face plate and retainer ring has been omitted. When the components are assembled, the orientations and positions of the alternate embodiment components would be the same as the orientations and positions of the first embodiment components in FIG. 4, but the interface engagement between the retainer ring and bulb flange would preferably define a bi-injection molding bond so that the retainer ring and bulb together constitute an integral structure.

What is claimed is:

1. A fluid dispenser comprising:

(A) a flexible fluid containment unit including (1) a flexible, squeezable reservoir bulb having a discharge opening;

(2) a flexible, deformable nipple having an inlet opening and a dispensing orifice; and (3) a flexible tether connecting said bulb with said nipple to accommodate (1) an unfolded configuration allowing access to the interior of said bulb for filling said bulb with fluid, and (2) a folded configuration locating said bulb discharge opening in communication with said nipple inlet opening, said fluid containment unit having a size sufficient with respect to an intended user to prevent the fluid containment unit from being swallowed by the intended user when the fluid containment unit is in either the unfolded configuration or folded configuration; and (B) a support unit including (1) a face plate through which said nipple can project;

(2) a retainer ring through which said bulb can project;

(3) a hinge that connects said face plate and retainer ring and that is located adjacent said tether to accommodate folding of said tether; and (4) a releasable latch for securing said face plate and retainer ring together to clamp between them said fluid containment unit when said fluid containment unit is in said folded configuration.

2. The fluid dispenser in accordance with claim 1 in which said fluid containment unit is a unitary molded structure.

3. The fluid dispenser in accordance with claim 1 in which said support unit is a unitary molded structure.

4. The fluid dispenser in accordance with claim 1 in which said face plate is generally rigid.

5. The fluid dispenser in accordance with claim 1 in which said retainer ring is generally rigid.

6. The fluid dispenser in accordance with claim 1 in which said latch is defined solely by a portion of said face plate and a portion of said retainer ring which form a releasable snap fit engagement.

7. The fluid dispenser in accordance with claim 6 in which said face plate includes a resilient tab having a projecting shoulder and a tapered surface; and said retainer ring has (1) a guide surface for engaging said tapered surface, and (2) an abutment surface for confronting said shoulder to latch said face plate and retainer ring together.

8. The fluid dispenser in accordance with claim 1 in which said face plate has a central opening for receiving said nipple; and said retainer ring has a central opening for receiving said bulb.

9. The fluid dispenser in accordance with claim 1 in which said face place has an arcuate locating wall for defining a receiving region for part of said fluid containment unit; and said retainer ring has an arcuate guide wall extending adjacent a portion of said fluid containment unit for guiding said face plate locating wall as said face plate and retainer ring are pivoted together to clamp said fluid containment unit.

10. A fluid dispenser comprising:

(A) a fluid containment unit including (1) a bulb having a discharge opening;

(2) a nipple having an inlet opening and a dispensing orifice; and (3) a tether connecting said bulb with said nipple to accommodate (1) an unfolded configuration allowing access to the interior of said bulb for filling said bulb with fluid, and (2) a folded configuration locating said bulb discharge opening in communication with said nipple inlet opening; and (B) a support unit including (1) a face plate from which said nipple can project;

(2) a retainer ring from which said bulb can project; and (3) a releasable latch for securing said face plate and retainer ring together to clamp between them said fluid containment unit when said fluid containment unit is in said folded configuration.

11. The fluid dispenser in accordance with claim 10 in which said fluid containment unit is a unitary molded structure.

12. The fluid dispenser in accordance with claim 10 in which said face plate is hinged to said retainer ring.

13. The fluid dispenser in accordance with claim 10 in which said support unit is a unitary molded structure.

14. The fluid dispenser in accordance with claim 10 in which said bulb deforms when squeezed.

15. The fluid dispenser in accordance with claim 10 in which said face plate has a size sufficient to prevent the face plate from being swallowed by the intended user.

16. The fluid dispenser in accordance with claim 10 in which said retainer ring has a size sufficient to prevent the retainer ring from being swallowed by the intended user.

17. The fluid dispenser in accordance with claim 10 in which said face plate is generally rigid.

18. The fluid dispenser in accordance with claim 10 in which said retainer ring is generally rigid.

19. The fluid dispenser in accordance with claim 10 in which said latch is defined solely by a portion of said face plate and a portion of said retainer ring which together can form a releasable snap fit engagement.

20. The fluid dispenser in accordance with claim 10 in which said nipple inlet opening is defined by an annular plug seal for being sealingly received in said bulb discharge opening.

21. The fluid dispenser in accordance with claim 10 in which said tether has a resiliency sufficient to urge said bulb away from said nipple when said support unit is not latched closed to clamp said fluid containment unit in said folded configuration.

22. The fluid dispenser in accordance with claim 10 in which said face plate defines a ventilation aperture outwardly of said nipple to admit air to the region adjacent the nose of a user.

23. The fluid dispenser in accordance with claim 10 in which said bulb has an exterior surface portion for supporting said dispenser on a flat surface.

24. The fluid dispenser in accordance with claim 10 in which said fluid containment unit has a plurality of apertures outwardly of, and around, said nipple inlet opening; and said support unit face plate includes a plurality of posts for each being received in one of said apertures in an interference fit to assist in retaining said fluid containment unit adjacent said support unit.

25. The fluid dispenser in accordance with claim 10 in which two spaced-apart film hinges hingedly connect said face plate to said retaining ring wherein said fluid containment unit tether can be located between said two film spaced-apart film hinges.

26. The fluid dispenser in accordance with claim 10 in which said face place has an arcuate locating wall for defining a receiving region for part of said fluid containment unit; and said retainer ring has an arcuate guide wall extending adjacent a portion of said fluid containment unit for guiding said face plate locating wall as said face plate and retainer ring are pivoted together to clamp said fluid containment unit.

27. The fluid dispenser in accordance with claim 10 in which said latch is defined solely by a portion of said face plate and a portion of said retainer ring which together form a releasable snap fit engagement.

28. The fluid dispenser in accordance with claim 27 in which said face plate includes a resilient tab having a projecting shoulder and a tapered surface; and said retainer ring has (1) a guide surface for engaging said tapered surface, and (2) an abutment surface for confronting said shoulder to latch said face plate and retainer ring together.

29. A hingeless fluid dispenser comprising:

a nipple having an inlet opening and a dispensing orifice;

a face plate that is separate from, but engageable with, a portion of said nipple and from which said nipple can project;

a retainer ring;

a bulb having a discharge opening, said bulb being non-removably attached to said retainer ring in a fixed operative position against said retainer ring to prevent the user from moving said bulb away from said fixed operative position while allowing access to the interior of said bulb for filling said bulb with fluid; and a releasable latch for securing said face plate and retainer ring together to clamp between them said nipple in an orientation with said nipple inlet opening in communication with said bulb discharge opening.

30. The fluid dispenser in accordance with claim 29 in which said bulb is bi-injection molded to said retainer ring.

31. A fluid dispenser comprising:

a nipple having an inlet opening and a dispensing orifice;

a face plate for engaging a portion of said nipple and from which said nipple can project;

a retainer ring;

a bulb having a discharge opening, said bulb deforming when squeezed, said bulb being non-removably attached to said retainer ring to allow access to the interior of said bulb for filling said bulb with fluid; and a releasable latch for securing said face plate and retainer ring together to clamp between them said nipple in an orientation with said nipple inlet opening in communication with said bulb discharge opening.

32. The fluid dispenser in accordance with claim 29 in which said face plate has a size sufficient to prevent the face plate from being swallowed by the intended user.

33. The fluid dispenser in accordance with claim 29 in which said retainer ring and attached bulb together define a structure which has a size sufficient to prevent the structure from being swallowed by the intended user.

34. The fluid dispenser in accordance with claim 29 in which said face plate is generally rigid.

35. The fluid dispenser in accordance with claim 29 in which said retainer ring is generally rigid.

36. The fluid dispenser in accordance with claim 29 in which said latch is defined by at least a portion of said face plate and a portion of said retainer ring which together can form a releasable snap fit engagement.

37. The fluid dispenser in accordance with claim 29 in which said nipple inlet opening is defined by an annular plug seal for being sealingly received in said bulb discharge opening.

38. A fluid dispenser comprising:

a nipple having an inlet opening and a dispensing orifice;

a face plate for engaging a portion of said nipple and from which said nipple can project;

a retainer ring;

a bulb having a discharge opening, said bulb being connected to said nipple with a tether, said bulb being non-removably attached to said retainer ring to allow access to the interior of said bulb for filling said bulb with fluid; and a releasable latch for securing said face plate and retainer ring together to clamp between them said nipple in an orientation with said nipple inlet opening in communication with said bulb discharge opening.

39. The fluid dispenser in accordance with claim 29 in which said face plate defines a ventilation aperture outwardly of said nipple to admit air to the region adjacent the nose of a user.

40. The fluid dispenser in accordance with claim 29 in which said bulb has an exterior surface portion for supporting said dispenser on a flat surface.

41. A fluid dispenser comprising:

a nipple having an inlet opening and a dispensing orifice, said nipple having a plurality of apertures outwardly of, and around, said nipple inlet opening;

a face plate for engaging a portion of said nipple and from which said nipple can project, said face plate including a plurality of posts for each being received in one of said apertures in an interference fit to assist in retaining said nipple adjacent said face plate;

a retainer ring;

a bulb having a discharge opening, said bulb being non-removably attached to said retainer ring to allow access to the interior of said bulb for filling said bulb with fluid; and a releasable latch for securing said face plate and retainer ring together to clamp between them said nipple in an orientation with said nipple inlet opening in communication with said bulb discharge opening.

42. A fluid dispenser comprising:

a nipple having an inlet opening and a dispensing orifice;

a face plate for engaging a portion of said nipple and from which said nipple can project;

a retainer ring;

a bulb having a discharge opening, said bulb being non-removably attached to said retainer ring to allow access to the interior of said bulb for filling said bulb with fluid;

a releasable latch for securing said face plate and retainer ring together to clamp between them said nipple in an orientation with said nipple inlet opening in communication with said bulb discharge opening; and two spaced-apart film hinges hingedly connecting said face plate to said retainer ring.

43. The fluid dispenser in accordance with claim 29 in which said face place has an arcuate locating wall for defining a receiving region for part of said nipple; and said retainer ring has an arcuate guide wall for guiding said face plate locating wall as said face plate and retainer ring are brought together to clamp said nipple.

44. The fluid dispenser in accordance with claim 29 in which said latch includes (A) a resilient tab on said face plate having a projecting shoulder and a tapered surface, and (B) a guide surface on said retainer ring for engaging said tapered surface, and (C) an abutment surface on said retainer ring for confronting said shoulder to latch said face plate and retainer ring together.

* * * * *